United States Patent [19]

Shaver et al.

[11] Patent Number: 4,652,073

[45] Date of Patent: Mar. 24, 1987

[54] ELECTRICAL CONNECTOR WITH OPTIONAL SIZE CORD OPENING IN COVER

[75] Inventors: William E. Shaver, Orange; Albert A. Pudims, Stratford, both of Conn.

[73] Assignee: Westinghouse Electric Corp., Pittsburgh, Pa.

[21] Appl. No.: 826,423

[22] Filed: Feb. 5, 1986

[51] Int. Cl.[4] ..... H01R 13/58; H01R 13/72

[52] U.S. Cl. ..... 339/103 M; 339/103 C

[58] Field of Search ..... 339/103, 104, 105, 107; 174/65 R

[56] References Cited

U.S. PATENT DOCUMENTS

| | | | |
|---|---|---|---|
| 1,215,249 | 2/1917 | Burns | 220/266 |
| 1,608,621 | 11/1926 | Sachs | 220/266 |
| 2,154,310 | 4/1939 | Kinnard | 301/373 |
| 3,874,760 | 4/1975 | Guthmiller et al. | 339/103 R X |
| 4,244,483 | 1/1981 | Bauer et al. | 220/3.2 |

FOREIGN PATENT DOCUMENTS

| | | | |
|---|---|---|---|
| 950384 | 10/1956 | Fed. Rep. of Germany | 339/103 C |

*Primary Examiner*—Eugene F. Desmond

*Attorney, Agent, or Firm*—G. H. Telfer

[57] ABSTRACT

An electrical connector is provided with means to expand the opening of the originally manufactured cover for different cord sizes by providing a ring of material readily fractured by the installer or user of the device to enlarge the opening.

6 Claims, 7 Drawing Figures

ELECTRICAL CONNECTOR WITH OPTIONAL SIZE CORD OPENING IN COVER

BACKGROUND AND SUMMARY OF THE INVENTION

This invention relates to electrical connectors which house contacts associated with plug blades or contacts to which plug blades are admitted by apertures in the housing.

Merely as a representative example of a connector which may be improved in accordance with the present invention reference is made to copending application Ser. No. 631,356, filed July 16, 1984 by Pudims and assigned to the present assignee now U.S. Pat. No. 4,556,273 issued Dec. 3, 1985, which is herein incorporated by reference for its general description of such connectors. It will be apparent from the following discussion that the invention is generally applicable to connectors that may be characterized as having an insulating body, of one or more parts, with a plurality of electrical contacts supported therein and with terminal means for attaching conductors to it. An insulating cover is disposed over the body and has a circular aperture for accommodating an electrical line cord containing the conductors attached to the terminal means in the body. The terminal means may be associated with plug blades or with internal female contacts for receiving plug blades.

The practice has been to have the circular aperture for the line cord in the cover set in the original manufacture of the cover to accommodate the largest size line cord contemplated for use with that particular connector. This necessarily leads to some proliferation of covers with different size line cord apertures. Several cord sizes, for example, are used in the industrial and commercial applications of particular interest for application of the present invention. These sizes range from that designated 18-3SJ, which has a diameter of 0.3 inch to 12-3S, which has a diameter of 0.655 inch. If a connector is made with a cover whose original cord aperture can receive the 12-3S cord size, it is clear that there is going to be a wide gap between the edge of that aperture in the cover and the smallest cord size which has less than half the diameter. Such gaps are considered in the trade to be detrimental to long-life performance because of greater chance for the entry of dirt and other contaminants and are also unsightly. Sometimes a flexible ring is disposed on the cover rim to help close the gap but this necessitates an additional element to be assembled with the product, which would preferably be avoided for economic reasons.

It is recognized that in other electrical products such as switch boxes or wiring boxes, it is sometimes the case that a housing member, usually metal, is adapted for receipt of electrical conductors by the use of "knockouts". A knockout is a portion of the housing wall that can be removed by a user to form an opening for a conductor. Sometimes concentrically arranged knockouts are provided so the user can select from them to form a desired size opening in that location. What has not been previously known is an electrical connector of the character above described in which there is easy means for a user to modify a cord aperture from that originally provided to one accommodating a larger size cord, and to do so in a manner so that the connector is not subject to having the cord aperture inadvertently changed by breakage and with materials and dimensions that lend themselves to economical, quantity production with high reliability.

By the present invention, an insulating cover for a connector is configured so as to receive, at the user's option, two or more different cord sizes. The cover is a unitary molded member of insulating material so that the additional features of this invention do not appreciably complicate the manufacturing operation or add to its expense as compared to former connector covers. As originally manufactured, the cover is configured with an aperture that has a removable circular ring at its periphery. The removable ring and the remaining portion of the cover have a fracturable joint between them consisting of a region of insulating material with a thickness that is substantially less than that of the major portion of the ring. The arrangement is such that a user may use the cover for a cord that is accommodated by the original aperture size or he may readily remove the removable ring for enlarging the aperture to accommodate a larger size line cord. The removal of the ring is very simply performed by forcing the blade of a tool such as a screw driver into a groove on the exterior of the cover between the ring and the rest of the cover right at the fracturable joint of the ring and the remaining portion of the cover. Alternatively, a screwdriver blade or the like may be inserted within the central aperture so that its extremity is on the underside of one part of the ring while another portion of the blade is on the exterior of another part of the ring. A prying motion of the blade results in the fracture of the joint and separation of the ring from the rest of the housing cover.

The material of the cover is suitably selected from the group consisting of polycarbonate material and polyphenylene oxide material because these materials have a combination of good qualities in terms of dimensional stability, non-hygroscopic characteristics, good impact strength, and good temperature rating without being too brittle. The invention may also be practiced with other molded plastic materials.

The above and other aspects of the invention will be better understood by reference to the following description and the accompanying drawing.

DESCRIPTION OF THE PREFERRED EMBODIMENTS

Figure 1:
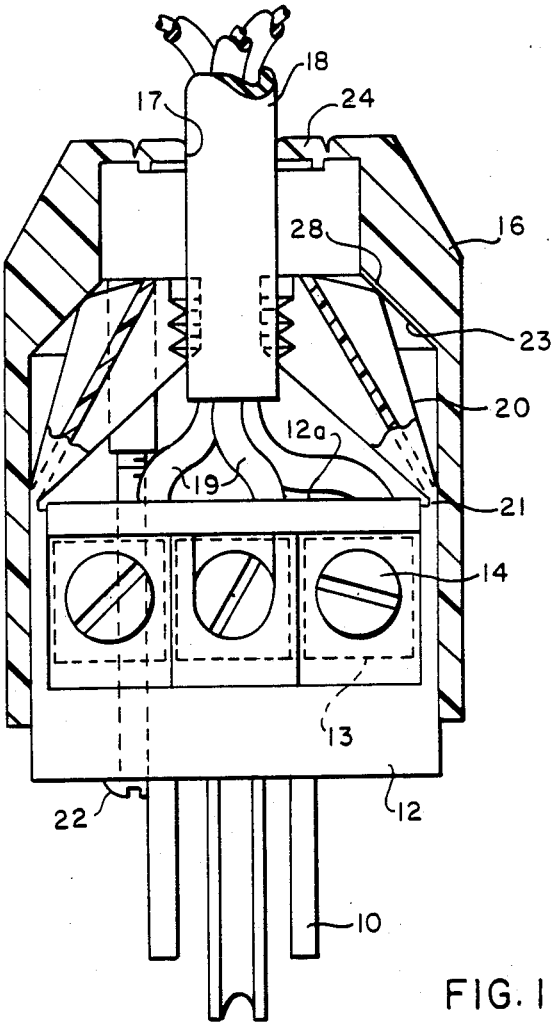
FIG. 1 is a sectional view of an electrical connector in accordance with an embodiment of the present invention.

FIG. 1 illustrates an overall view of a connector incorporating an embodiment of the present invention. The connector shown is a plug with extending male blades 10 for mating with another connector, or a receptacle, having internal female contacts. However, devices in accordance with the invention may be connectors of either the male or female type. The device includes an insulating body 12 such as of a molded plastic material. The body 12 has a plurality of electrical contacts 13 supported in it. The contacts have terminal means 14, such as screws, for attaching conductors respectively thereto. The contacts 13 are not shown in detail; they may be suitably configured in accordance with prior practice.

An insulating cover or cap 16 is disposed over the body 12. An aperture 17 in the cover 16 accommodates an electrical line cord 18 which enters within the cover to the space adjacent the body 12 where conductors 19 contained within the line cord are attached to the terminal means 14 on the body.

As shown in this embodiment, the connector has a plurality of grip fingers 20 joined together at a flexible joint 21 integral with the body 12 at the outer periphery thereof. The fingers 20 are allowed by the flexible joint 21 to move radially against the line cord 18. When fully assembled by the securing of fasteners between the cover 16 and body 12, the fingers 20 are forced by the cover at their region of contact 28 into tight engagement with the connected line cord 18. The grip fingers 20 may each have a longitudinally running hinge with a portion on each side thereof that permits circumferential spreading of the finger portions around the cord 18 as a result of the force of the cover 16 bearing against them in accordance with the above-mentioned copending application. The present invention may be practiced regardless what, if any, type of cord grip arrangement is employed in the connector.

Figure 2:
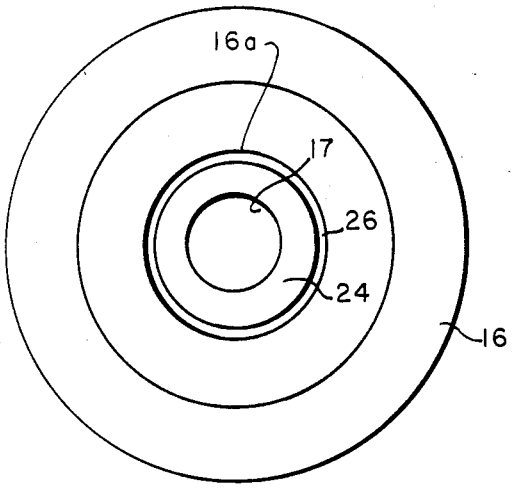
FIGS. 2 and 4 are, respectively, a top view and a side sectional view of a connector cover.
Figure 3:
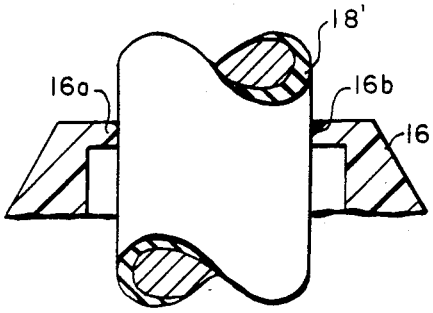
FIG. 3 is a partial sectional view of a connector in which the cord opening has been enlarged from that of FIG. 1.

As shown, the cover aperture 17 for the line cord 18 is the smaller of two sizes for which this cover can be adapted. The line cord 18 passes through the aperture 17 without interference and with a minimal gap. The aperture 17 is bounded by a ring of material 24, also shown in FIG. 2 for the separate cover 16, that is, in accordance with the present invention, removable for use of the cover with a line cord 18' of larger diameter, as is shown in FIG. 3 with a larger aperture.

Figure 4:
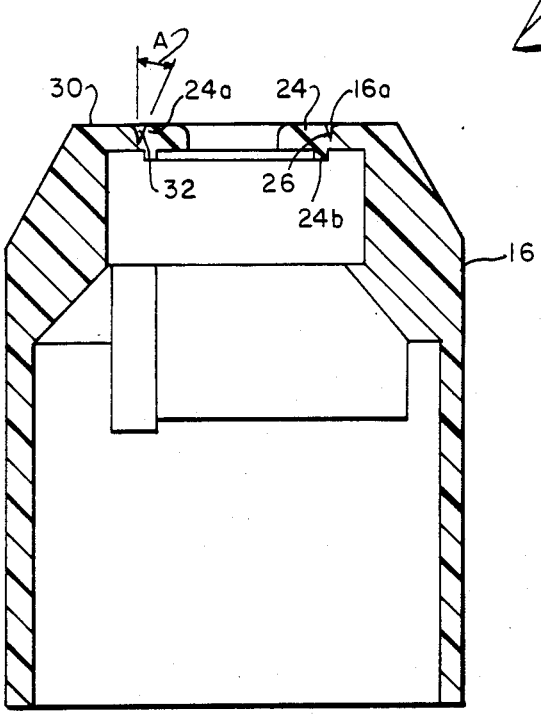

FIG. 4 shows a sectional view of the separate cover 18. The insulating cover 18 is a unitary molded member so that as shown in FIGS. 2 and 4 the circular ring 24 at the periphery of the aperture 17 is joined with the remainder of the cover, specifically the immediately adjacent portion **16*a* of the cover, at a joint 26 of reduced thickness compared to a major portion of the ring 24** itself.

The exterior of the ring 24 and the immediately adjacent portion **16*a* of the rest of the cover 16 have surfaces substantially in a common plane 30 with a groove 32 between them at the joint 26. The joint 26 is of a reduced thickness of, for example, about 10% to about 30% of the major portion of the ring 24 or, more specifically, by way of further example, from about 0.015 inch to about 0.019 inch where the ring thickness (not including inner ring portion 24*b*** which may itself be about 0.015 in. thick, for example) is about 0.094 inch, that is, a range of from about 16% to about 20%.

The interior surface of the ring 24 has an interior ring portion **24*b* whose outside periphery coincides with the location of the groove 32 and joint 26. This helps ensure that a clean break occurs at the joint 26**.

The configuration of the groove 32 is made so the mating part of the mold in which the cover 16 is formed can have sufficient strength. In this example, the ring 24 itself has a surface portion **24*a* extending at an angle A, shown in FIG. 4, to a normal to the front surface plane 30** of, for example, about 15° to about 30° or, more specifically, about 20° as has been utilized in actual devices made and tested.

A number of materials have been considered for use in the practice of the present invention. It is possible to use a wide range of molded plastic materials with careful tailoring of the dimensions of the cover 16 in order to ensure proper breakage of the joint 26 when desired but without inadvertent breakage. The breakage of the joint 26 to remove the ring 24 occurs by the application of the screwdriver blade to the groove in the manner as shown in FIG. 5 or as shown in FIG. 6.

Suitable molded plastic materials for the cover 16 include a modified polyphenylene oxide such as that available under the trade name Noryl material or a polycarbonate material whose properties are largely consistent with Noryl material, such as ABS polycarbonate or Lexan polycarbonate or Merlon polycarbonate. These materials have good properties and may be preferred in some instances to others such as Nylon or urea and phenolic materials which may also be used. The cover material should permit easy removal of ring 24 when desired but without much risk of inadvertent breakage.

Figure 5:
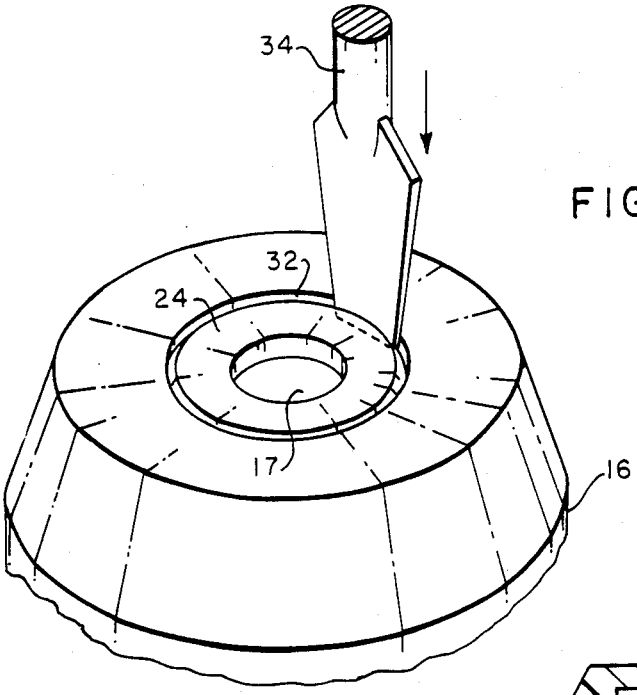
FIGS. 5 and 6 are partial perspective view of techniques to enlarge the cover cord opening.

In FIG. 5, a screwdriver blade 34 is placed directly in groove 32 with pressure applied against the joint 26, as shown by the arrow. If the joint 26 is not completely fractured along its entire length, the operation of the screwdriver blade 34 is simply repeated at another location in groove 32. This technique generally works well on the various materials mentioned above.

Figure 6:
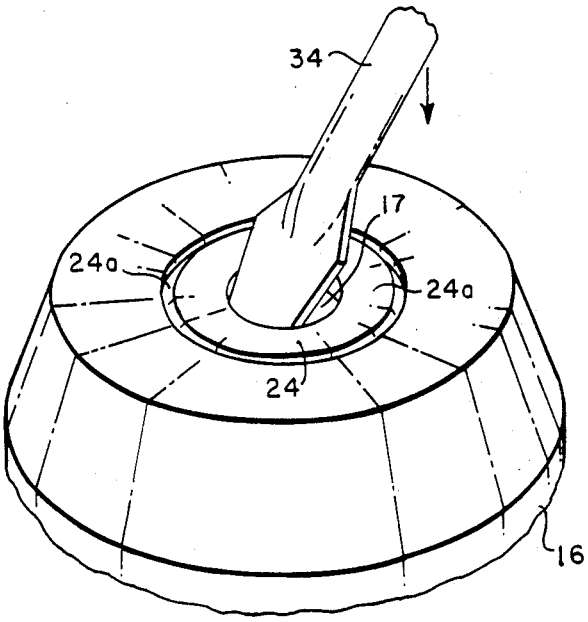

In FIG. 6, another method for removing ring 24 is shown in which screwdriver blade 34 is inserted into aperture 17 so its extremity underlies one portion **24*a* of the ring while another part of the blade rests on the exterior of another portion 24*b* of the ring. Then with a downward motion on the blade handle, as shown by the arrow, the joint 2** is fractured, repeating the operation in another position if necessary.

Another technique, not illustrated, is simply to bear against the exterior of the ring 24 itself with a screwdriver blade held with its end on a radius across the ring.

By way of further example, devices have been made in accordance with the foregoing description in which the original cord aperture 17 in the cover had a diameter of about 0.400 inch and thus accommodated cords up to 14-3SJ (maximum diameter 0.395 in.). Removal of ring 24 from such covers formed an aperture 17' with a diameter of about 0.670 inch. Such a size accommodates cords up to size 12-3S (diameter 0.655 in.).

Figure 7:
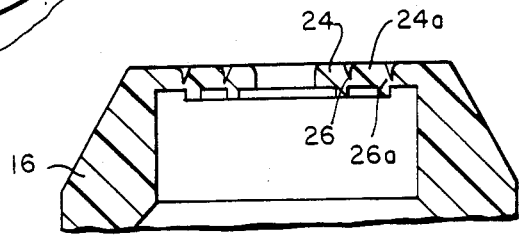
FIG. 7 is a partial sectional view of a connector cover in accordance with a further embodiment of the invention.

Other forms in which the invention may be practiced are those in which there is more than one ring on the cover so that a succession of sizes are available to the user. Such a configuration is shown in FIG. 7. In such a situation, rings 24 and **24*a* are concentric and generally joints 26 and 26*a* between are of the same character as that of the previous Figures. It is, however, preferable that the inner ring 24 be more easily removed than the outer ring 24*a* so that when one wishes to go to the next larger aperture size from the original opening, it is easy to remove just the first ring 24 without severing the second ring 24*a* from the cover 16. To do so, inner joint 26 may be thinner than outer joint 26*a* such as by having joint 26 about 15% of the thickness of the rings and joint 26*a*** about 25% of the ring thickness.

The groove 32 need not be continuous as shown. The cover may also be formed with spaced portions at the intended joint not having a groove and yet the required fracturing of the material to remove the ring 24 can still be performed and the chance of inadvertent fracturing is further minimized. For example, the groove may occur in three or four spaced segments with intervening ungrooved material.

It is, therefore, seen that the invention provides additional flexibility in the use of connectors for different conductor sizes while minimizing and economizing on the number of connector covers that have to be manufactured. Various changes and modifications may be made in practicing the invention consistent with the description herein.

We claim:

1. An electrical connector comprising:

an insulating body with a plurality of electrical contact elements supported therein and terminal means for attaching conductors respectively thereto, said plurality of electrical contact elements being adapted for mating with another plurality of electrical contact elements of another wiring device;

an insulating cover disposed over said body and having a circular aperture for accommodating an electrical line cord containing conductors attached to said terminal means of said body;

said insulating cover being a unitary molded member of insulating material configured with a removable circular ring at the periphery of said aperture, said removable ring and a remaining portion of said cover having a fracturable joint therebetween, said fracturable joint consisting of a region of insulating material having a thickness that is substantially less than that of a major portion of said ring, permitting ease of removal of said ring for enlarging said circular aperture of said cover to accommodate an electrical line cord of larger diameter than that accommodated by said circular aperture in absence of removal of said ring.

2. An electrical connector in accordance with claim 1 wherein:

said ring and said remaining portion of said cover immediately adjacent said joint having substantially coplanar exterior surface portions with a groove therebetween outside of said joint.

3. An electrical connector in accordance with claim 2 wherein:

said thickness of said region of insulating material of said joint is from about 10% to about 30% of that of said major portion of said ring.

4. An electrical connector in accordance with claim 3 wherein:

said ring has a surface extending into said groove that is at an angle of about 15° to about 30° from a normal to said exterior surface portion.

5. An electrical connector in accordance with claim 4 wherein:

said angle is about 20°.

6. An electrical connector in accordance with claim 3 wherein:

said insulating cover comprises a molded material selected from the group consisting of polycarbonate material and polyphenylene oxide material.

* * * * *